US005406254A

United States Patent [19]

Le Nay et al.

[11] Patent Number: 5,406,254

[45] Date of Patent: Apr. 11, 1995

[54] ALARM SYSTEM WITH REMOTE MODULE AND ASSOCIATED ALARM

[75] Inventors: Tom W. Le Nay, Encino, Calif.; William R. Vogt, Rockaway, N.J.; Donald L. Hadden, Calgary, Canada

[73] Assignee: Borg-Warner Security Corporation, Chicago, Ill.

[21] Appl. No.: 981,666

[22] Filed: Nov. 25, 1992

[51] Int. Cl.[6] ..... G08B 21/00

[52] U.S. Cl. ..... 340/501; 340/505; 340/636

[58] Field of Search ..... 340/333, 310 R, 505, 340/506, 509, 825.36, 513, 511, 501

[56] References Cited

U.S. PATENT DOCUMENTS

| | | | |
|---|---|---|---|
| 4,394,655 | 7/1983 | Wynne et al. | 340/511 |
| 4,463,352 | 7/1984 | Forbes et al. | 340/505 |
| 4,785,285 | 11/1988 | Teich et al. | 340/505 |
| 4,796,025 | 1/1989 | Farley et al. | 340/825.36 X |
| 4,916,432 | 4/1990 | Tice et al. | 340/505 |
| 5,138,562 | 8/1992 | Shaw et al. | 340/501 |
| 5,194,846 | 3/1993 | Lee et al. | 340/505 |

*Primary Examiner*—Jeffery A. Hofsass

*Attorney, Agent, or Firm*—Laff, Whitesel, Conte & Saret

[57] ABSTRACT

An alarm system has a controller which communicates over a conductive path with a remote module. An indicating device, such as an alarm bell, strobe light, audible horn or other device is coupled to the remote module and activated when a control signal is received from the controller. A rechargeable battery is provided in or adjacent the remote module, and acts as a reservoir for the power to energize the indicating device upon connection. The remote module receives charging current over the conductive path from the controller, and this current is very low, substantially less than the current level required to energize the bell, horn, or strobe. A constant power dc-to-dc converter is provided to charge the battery at the appropriate rate, while drawing a substantially lesser amount of power from the controller. Both the rechargeable battery and the indicating device are supervised, and any malfunction reported to the controller.

27 Claims, 7 Drawing Sheets

FIG.5
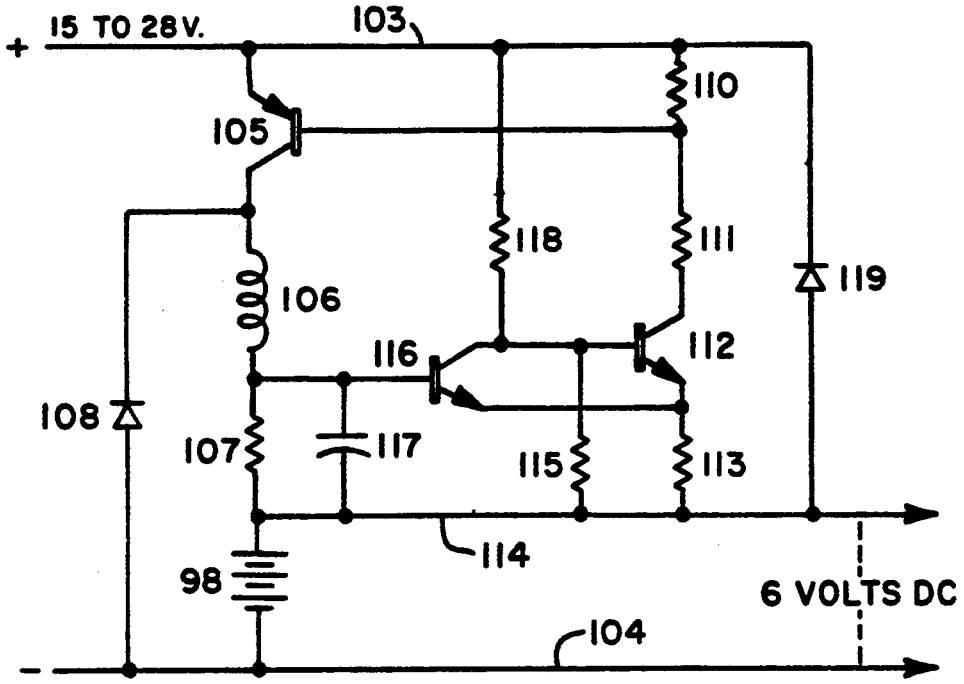
Constant Power DC-To-DC Converter
97
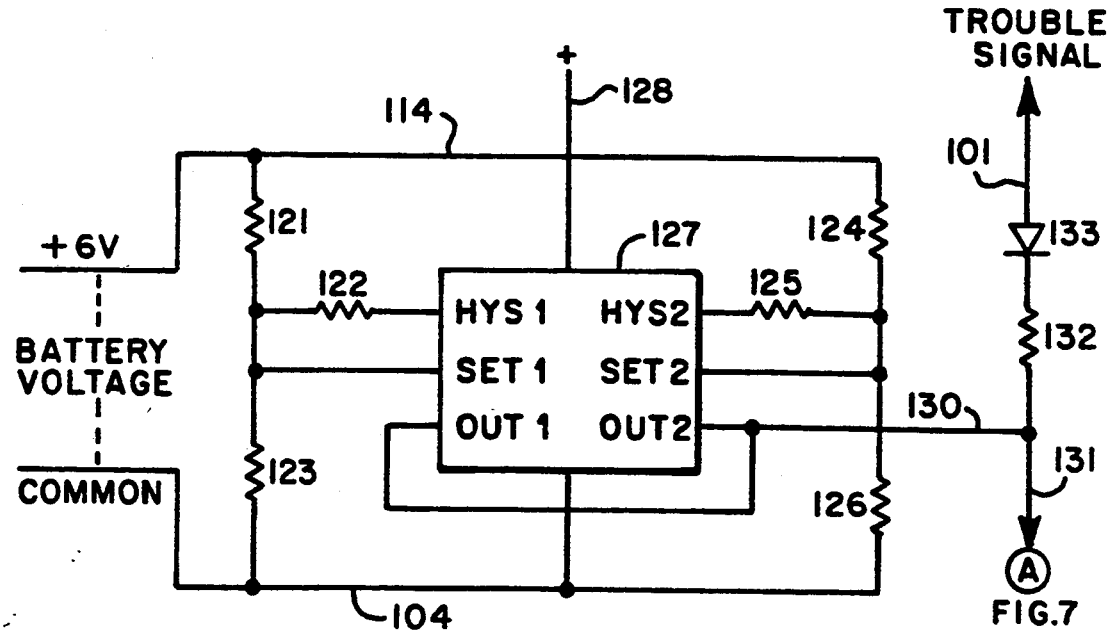
Low Voltage and High Voltage Supervisory Circuit
100
FIG.6

Bell Supervisory Circuit
93

Battery Low Voltage
Cutoff Circuit

6v To 24v DC-To-DC Converter

ALARM SYSTEM WITH REMOTE MODULE AND ASSOCIATED ALARM

FIELD OF THE INVENTION

The present invention is directed to an alarm system in which a controller is coupled to a remote module, which has an indicating unit such as a bell or strobe light attached to the module. More particularly the invention includes a rechargeable battery at the remote module for energizing the bell. The alarm-driving energy is locally stored, in the battery, but remotely supplied, by charging current from the controller.

BACKGROUND OF THE INVENTION

Known alarm systems provide communication between a central station, or controller, and a plurality of remote transponders connected for two-way communication with the controller. It is known to address the transponder so that each of the individual transponders recognizes its respective address, and thus "knows" when the particular data transmitted from the controller is intended for that specific transponder. The transponder can be used to control associated units such as flashing a light-emitting diode (led), changing the state of a relay, energizing an indicating device (such as ringing a bell or flashing a strobe light), and similar functions provided locally adjacent the addressed transponder. For a background in such alarm/communication systems, see U.S. Pat. Nos. 4,394,655, issued Jul. 19, 1983; 4,470,047, issued Sep. 4, 1984; and 4,507,652, issued Mar. 26, 1985. All three patents are hereby incorporated herein by reference. All three are entitled "Bidirectional, Interactive Fire Detection System", and are assigned to the assignee of this invention.

In previous systems power consumption and related considerations militate against the use of bells at long distances from the control panel. Motor driven bells consume considerably less power than their predecessors of the vibrating type, but do not entirely alleviate the problem. Backup batteries in alarm systems are required by regulatory agencies to be capable of operating bells (and other indicating devices) for a specified period of time at the end of a specified period of power outage (usually 24 hours). That means the battery, now at a lower capacity with respect to the onset of the power failure, is expected to do the hardest job—drive the bell or a strobe light—after its capacity has been lowered by powering the system during the power outage.

When a bell is placed a long distance from the controller, a higher voltage battery is needed (usually 12 or 24 volts), as are larger wire sizes. An alternate method is to have a power supply located in the vicinity of the remote bell, which has its battery charged from a commercial ac power source directly connected to the power supply. In this case the bells are remotely controlled from the controller.

It is therefore a principal consideration of the present invention to provide an alarm system in which a plurality of indicating units, such as bells, horns or strobe lights, can be conveniently and economically energized and run in one loop, with substantially longer conductor runs and smaller conductor wire size, without compromising the system operation.

It is another important consideration of the present invention to provide such a system in which the remote module controlling the alarm-indicating device includes an arrangement for supervising the indicating device itself.

Still another important consideration is to provide such a system in which the alarm-indicating unit is powered from a local energy reservoir, such as a rechargeable battery, but in which the reservoir is replenished from the controller at a very low charging rate.

Yet another important consideration is to provide such a controller and remote module in an addressable alarm system, so that the controller can designate a specific module to sound its associated bell or horn, or flash its associated strobe, and the controller can also recognize the specific remote module which has either a battery malfunction or some anomaly in the circuit of the alarm indicating device.

Another important consideration is to provide a system in which the energy in the indicating device's reservoir (or battery) is not depleted during a power outage, before the indicating device is required to be energized.

Lastly, an important consideration is to provide such a system where the remote indicating device module can be connected to, and share, the communication circuit in an alarm system.

SUMMARY OF THE INVENTION

The present invention is particularly useful in an indicating system which includes a controller and at least one module positioned remotely from the controller. An indicating device, which can be a bell, horn, strobe light, or other unit, is coupled to the remote module. The controller includes means to activate the indicating device when desired. The rechargeable battery is positioned in close proximity to the remote module, for energizing the indicating device when the controller sends a control signal to the remote module. "Close proximity", as used herein and in the appended claims, means the rechargeable battery can be either inside or outside the housing for the remote module, or adjacent the bell. An electrically conductive path is provided between the controller and the remote module, for passing energy from the controller to the rechargeable battery. This system provides a relatively low level of energy to the battery, a level less than that required to activate the indicating device but more than adequate to maintain the battery at its appropriate charged level.

In accordance with another feature of the invention, the remote module includes means for supervising the rechargeable battery, and also for supervising the indicating device, whether a bell, horn, strobe light or other unit.

THE DRAWINGS

In the several figures of the drawings, like reference elements indicate like components and in those drawings:

FIGS. 5–7 are schematic diagrams depicting various circuit details of the components shown more generally in FIG. 4.

DETAILED DESCRIPTION OF THE INVENTION

Figure 1:
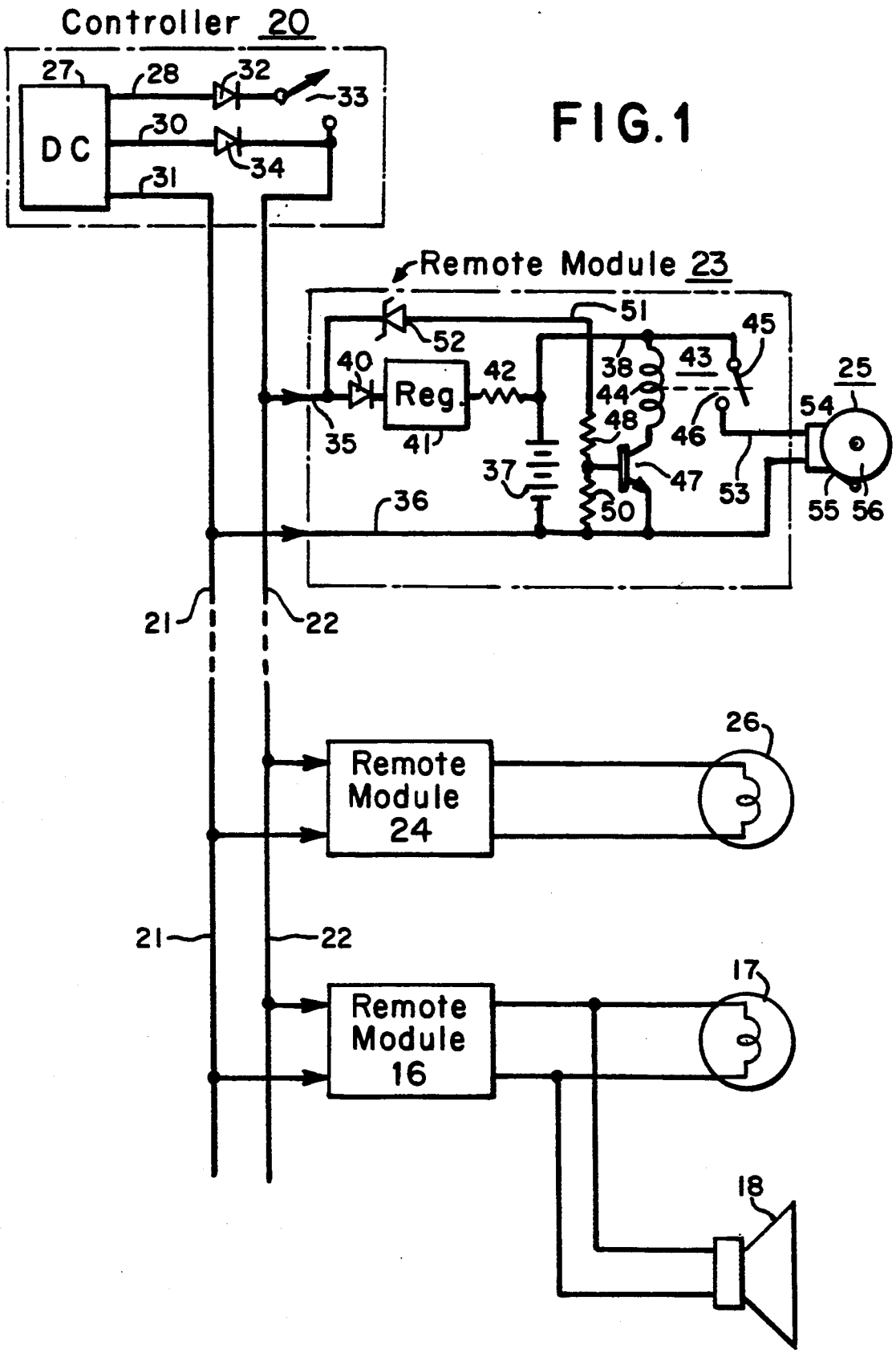
FIG. 1 is a block diagram, partially in schematic form, indicating a general arrangement for an alarm system with a remote module and associated indicating device, constructed in accordance with the invention.

FIG. 1 shows an indicating system which includes a controller 20 coupled over an electrically conductive path including conductors 21,22 to remote modules 23 and 24. The conductive path could comprise only a single electrical conductor between the controller and each of the remote modules, with a ground or earth reference connection at each individual unit. An indicating device 25, shown as an alarm bell, is coupled to the remote module 23, and another indicating device 26, shown as a strobe light, is coupled to remote module 24. A third remote module 16 is coupled to conductors 21,22, and to both a visual alarm (strobe 17) and to an audible alarm (horn 18). Different indicating devices, such as flashing strobe lights, sirens, and so forth can of course be connected in place of the bell device shown in FIG. 1.

In controller 20 is a source 27 of dc voltage, provided on output conductors 28 and 30 with respect to a reference or ground voltage on conductor 31. For purposes of this explanation it will be considered that a 24-volt potential is provided on conductor 28 with respect to that on 31, and a voltage of 12 volts is provided on conductor 30 with respect to the ground reference on line 31. A first diode 32 has its anode coupled to conductor 28 and its cathode coupled through a contact set 33 to conductor 22. Diode 34 has its anode coupled to conductor 30, and its cathode coupled to conductor 22. The ground reference conductor 31 is coupled directly to conductor 21 of the conductive path. With switch or contact set 33 in the position shown, a potential of 12 volts with respect to ground is coupled over conductors 22,21 to the input conductors 35,36 of remote module 23. When contact set 33 is closed, the voltage on conductor 22 with respect to that on conductor 21 is raised from 12 to 24 volts. Together the different voltage conductors, diodes 32 and 34, and contact set 33 comprise means to activate the indicating device, as will become evident.

In module 23 a rechargeable battery 37 is coupled as shown between conductor 38 and conductor 36. The charging path for the battery thus includes conductor 22, conductor 35, diode 40, regulator 41, resistor 42, conductor 38, the battery 37 itself, and conductor 36 back to conductor 21. In simplest terms regulator 31 and resistance 32 can be considered an impedance in the charging circuit. A dc-to-dc converter is preferably used in the place regulator 41 is shown, to provide an optimum charging current through resistor 42 although only a relatively small current (on the order of two milliamperes, or ma) is received over the main path of conductors 21,22. Those skilled in the art understand that such converters normally first produce an alternating-current (ac) output from dc input, and then in a second step provide an output of dc voltage from the ac intermediate power. This allows the charging voltage and power to be reduced while the charging current is stepped up for most efficient charging of the rechargeable battery 37.

A relay 43 includes a winding 44, a movable contact 45, and a fixed contact 46. Winding 44 is coupled between conductor 38 and the collector of an npn type transistor 47, the emitter of which is coupled to conductor 36. The base of transistor 47 is coupled to the junction point between resistors 48 and 50. The other end of resistor 48 is coupled over conductor 51 to the anode of a Zener diode 52, the cathode of which is coupled to connector 35. The other side of resistor 50 is coupled to conductor 36. Fixed contact 46 of relay 43 is coupled over conductor 53 to one side of a motor 54, a part of the indicating device 25. The other terminal of motor 54 is coupled to common conductor 36 in the remote module 23. When dc motor 54 is energized by closure of the contacts 45,46, it drives the hammer arm 55 to strike the gong 56 in indicating device 25. Components 54, 55 and 56 are collectively considered the indicating device. Rechargeable battery 37 is in close proximity to the indicating device 25, usually only a matter of a few feet from remote module 23. The battery 37 can be within the case of the remote module or outside the case.

In operation, to provide charging current to battery 37, the circuit operates as shown with contact set 33 open. Current flows from the 12-volt conductor 30 through diode 34, conductors 22 and 35, diode 40, regulator 41, resistor 42, battery 37, and conductors 36 and 31 back to the common or reference connection in the dc supply 27. This provides charging current adequate to maintain the appropriate voltage level in battery 37.

When it is desired to energize indicating device 25, contact set 33 in controller 20 is closed. This provides a 24-volt voltage over conductor 28, diode 32, contact set 33, and conductor 35 to Zener diode 52, which has a greater than 12-volt breakdown voltage. Accordingly current flows through this diode and over conductor 51, through resistors 48 and 50 to common conductors 36,31. The signal developed between resistors 48 and 50 drives on the base-emitter junction of transistor 47, which turns on and provides a path for current flow through relay winding 44, which effects the closure of contact set 45,46. This completes the obvious dc circuit for energizing the motor 54 and actuating the indicating device, by having the clapper 55 strike the gong 56.

Battery 37 can be considered an energy storage device, for storing an amount of energy large with respect to that provided by the trickle level current charge normally provided through diode 40. In other words when the bell 25 is sounded, the necessary energy is locally stored and supplied from battery 37. At other times when the bell is not sounding, the charging energy is provided from a remote location. The provision of a locally stored, but remotely supplied, energy source is an important feature of the present invention.

In a preferred embodiment of the invention, the battery was only a six volt battery and was charged at a level of about 6 milliamperes (ma), taking about 4½ days to charge to its full capacity. The battery 37, before being installed in the system, should be pre-charged.

Figure 2:
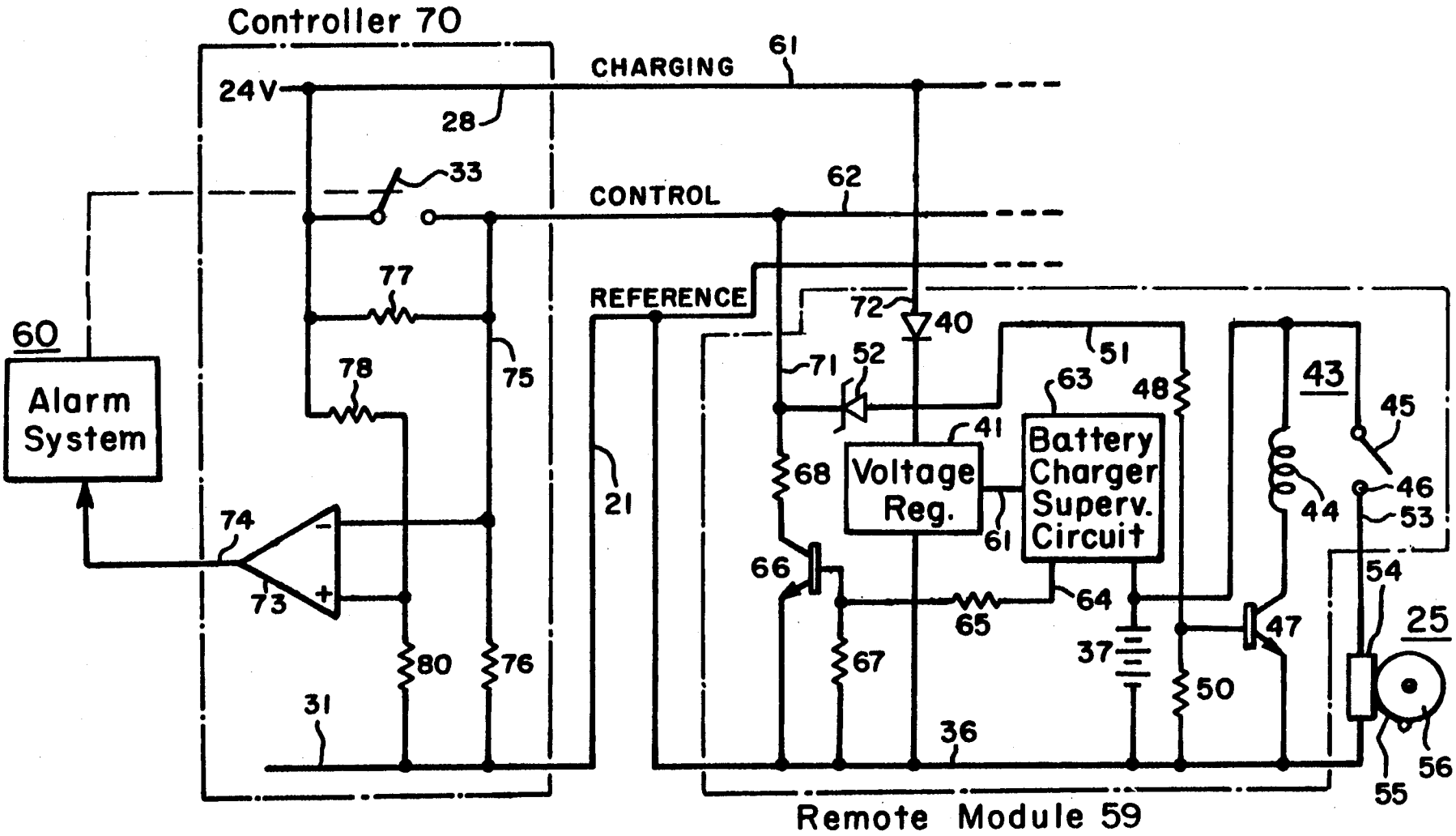
FIG. 2 is a schematic diagram depicting another embodiment of the invention, including supervision for the alarm system.

FIG. 2 indicates how the arrangement of the invention can easily be combined with a conventional alarm system 60, and shows other important features. The electrical charging energy and the command signal were both provided over conductor 22 in FIG. 1. In FIG. 2 the power and signal functions are split over conductors 61 and 62. In addition, another important feature of the invention shown in FIG. 2 is the battery charger and supervisory circuit 63, which monitors the battery as will be explained, and provides an output signal over conductor 64 when an abnormality is detected in the circuit. Conductor 64 is coupled through a resistor 65 to the common connection between the base of npn type transistor 66 and one end of resistor 67, the other end of which is coupled to conductor 36. The emitter of transistor 66 is also coupled to conductor 36. The collector of this transistor is coupled through a resistor 68 to the cathode of Zener diode 52, and over conductor 71 to signal path or control conductor 62. The anode of diode 40 is coupled over conductor 72 to power conductor 61, which passes charging current to remote module 59.

Controller 70 includes means (not shown) for providing a voltage level of approximately 24 volts on conductor 28, and also includes a ground reference conductor 31. A switch or contact set 33 is provided as before, for producing the ring-bell signal when activated by an output signal from alarm system 60. Alarm system 60 evaluates the output of a comparator 73, which passes its output signal over conductor 74 to alarm system 60.

The switch 33, when closed, completes a circuit between line 28 and both output signal conductor 62 and internal conductor 75, which is coupled through another resistor 76 to reference conductor 31. Another resistor 77 is coupled between conductor 28 and conductor 75, and a resistor 78 is coupled between conductor 28 at one terminal, with the other terminal of the resistor 78 being coupled to the common connection of resistor 80 and the plus input connection of comparator 73. The minus input connection of comparator 73 is coupled to the conductor 75 which is a point in the voltage divider circuit including resistors 76 and 77.

The battery charger and supervisory circuit 63 depicted in FIG. 2 is now a conventional circuit, of the type frequently used in charging batteries for cameras, for example. The semiconductor circuit (or "chip") is commercially available from Harris Semiconductor, and its designation is ICL 7665. When the system is energized by providing the 24 volt potential difference on conductor 28 in controller 70 with respect to ground conductor 31, power is supplied over conductor 61, conductor 72, and through diode 40 to voltage regulator circuit 41. In general, a voltage regulator is not required; only a rectifier is needed. Voltage is supplied from regulator circuit 41 over conductor 81 to one input of battery charger and supervisory circuit 63, which also receives an input from the connection to rechargeable battery 37. When supervisory circuit 63 recognizes a malfunction in the circuit, such as the battery connections being reversed, or the battery open or the battery shorted or completely discharged, a "trouble output" signal is provided over conductor 64 and through resistor 65 to drive on transistor 66. As it conducts this effectively places resistor 68 in parallel with resistor 76, lowering the voltage at the minus (inverting) input of comparator 73 and providing a trouble output signal over conductor 74 to alarm system 60. When the alarm system recognizes the trouble condition is present, it makes an appropriate response.

Figure 3:
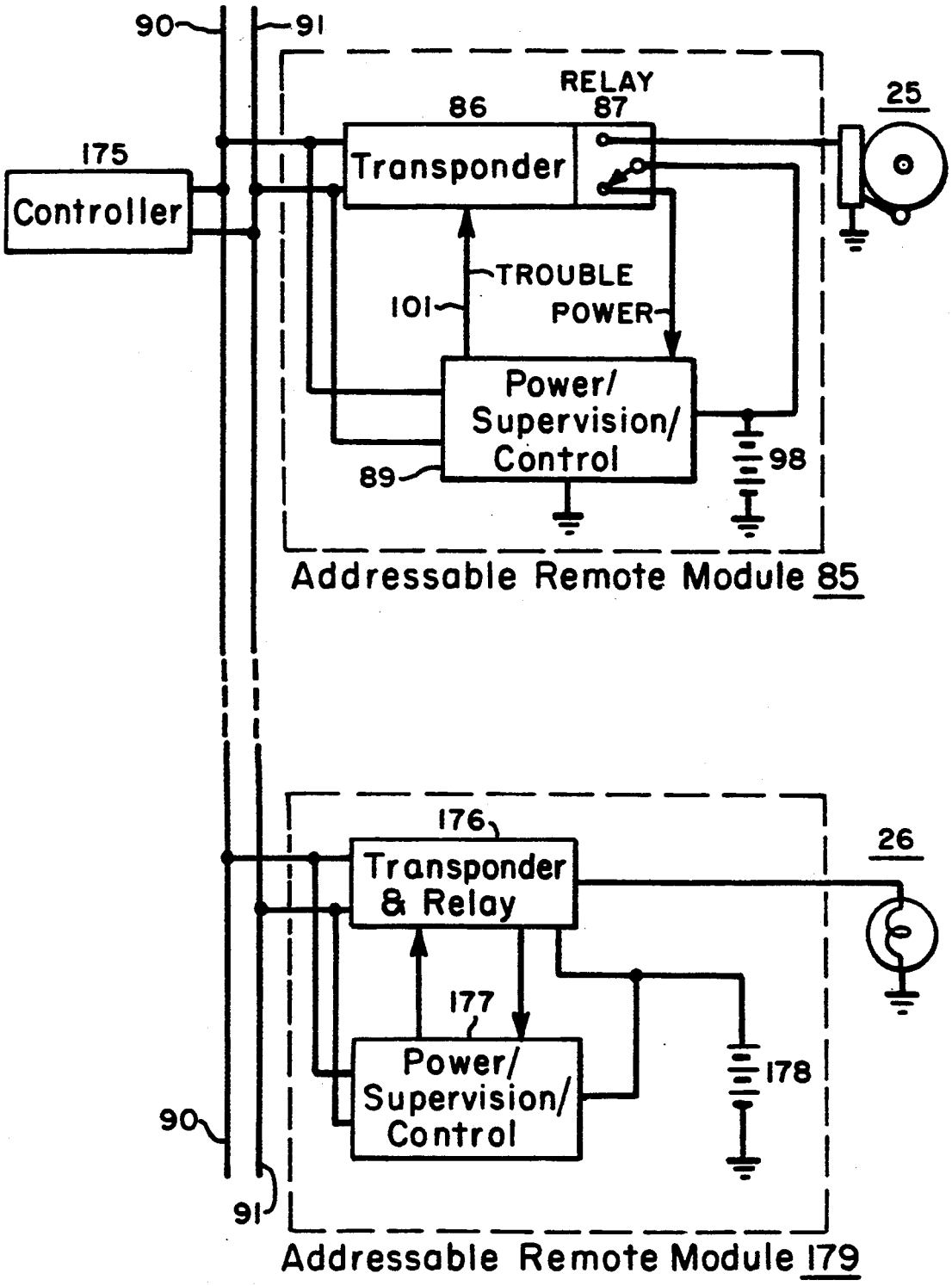
FIG. 3 is a block diagram depicting an addressable alarm system in which the invention is useful.
Figure 7:
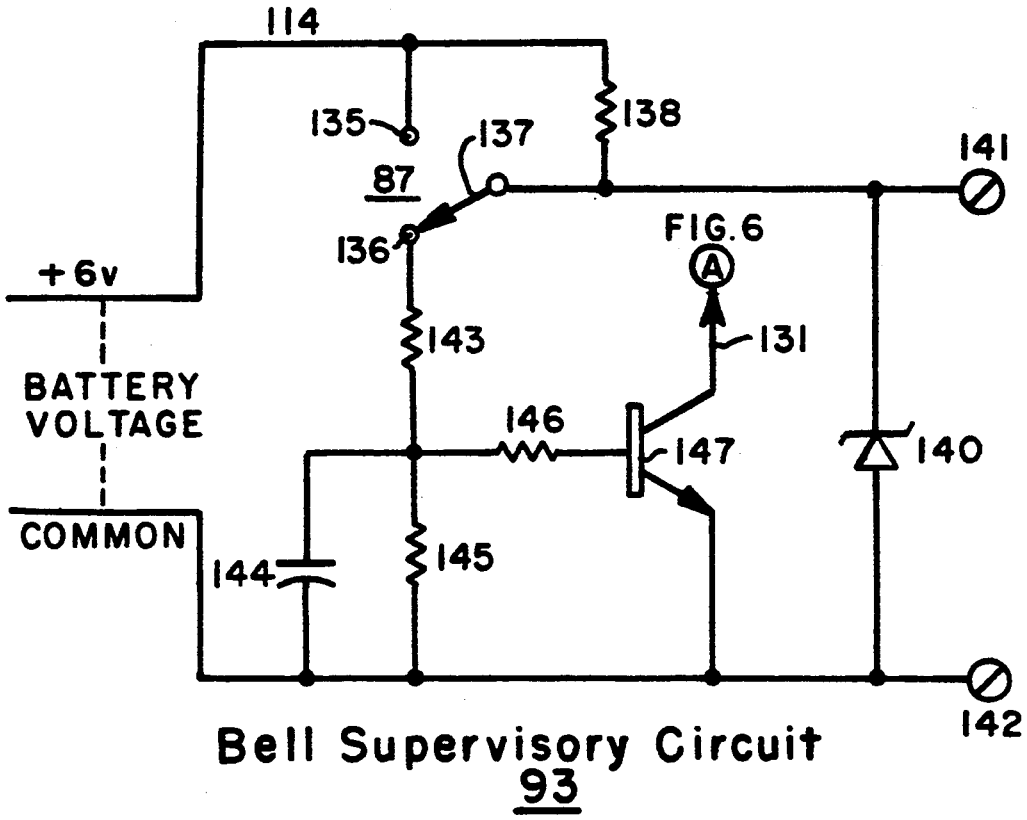
Figure 9:
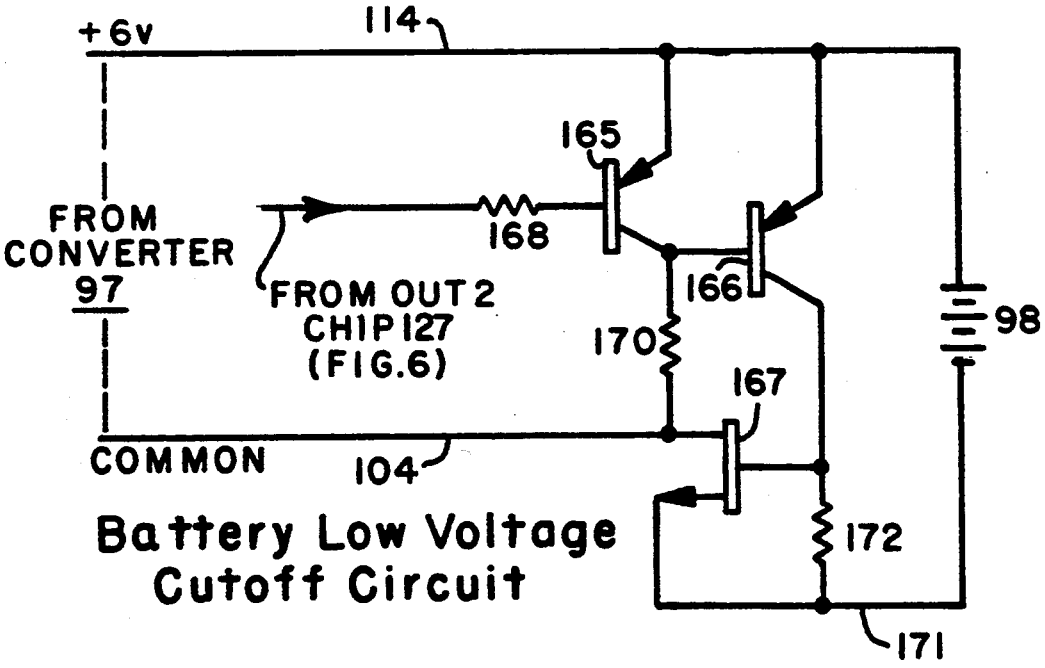
FIGS. 8 and 9 are schematic diagrams depicting additional circuits which may be incorporated in the addressable remote module shown in FIG. 4.
Figure 8:
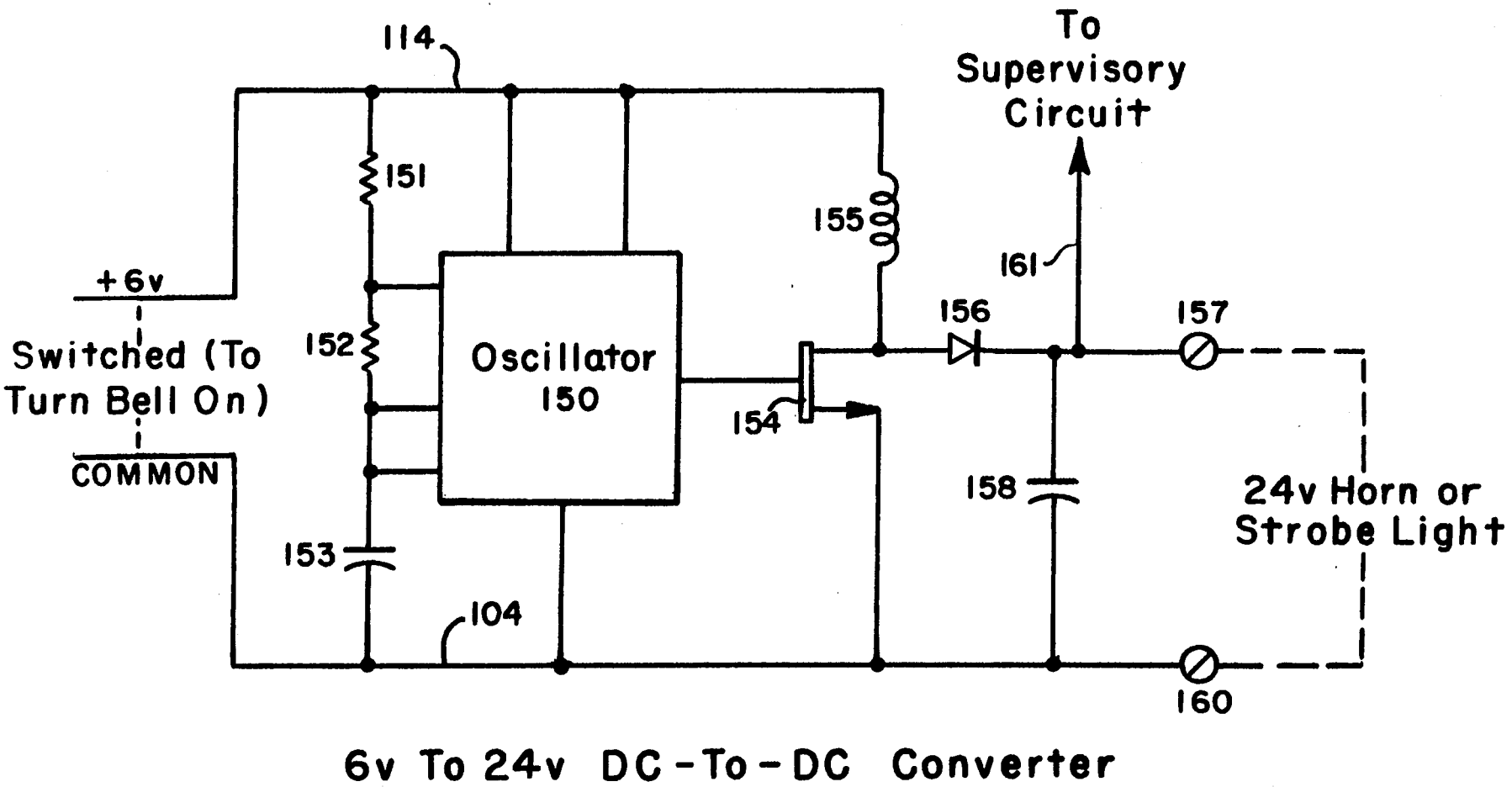

FIG. 3 depicts the manner in which the remote module already described can be incorporated in an addressable alarm communication system of the type described and referenced in the three cited patents. As shown in FIG. 3 a controller 175 is coupled to conductors 90,91 for transmitting signals to a plurality of addressable remote modules, and receiving information back from those modules. As shown in the cited patents, each of the modules has a transponder which includes an individual address different from the other transponder addresses, and each transponder recognizes when it has been individually addressed. Bus conductors 90,91 afford a communication path between controller 175 and as many of the remote modules as may be connected on a single loop. A transponder 86 as shown in FIG. 3 and the associated relay 87 can be easily constructed from the teaching in U.S. Pat. No. 4,507,652. The transponder is shown, by way of example, in FIG. 7 and the latching relay 75 of the patent is analogous to module relay 87 in FIG. 3 of this application. FIGS. 8 and 9 of the '652 patent show further details of the conventional transponder. The indicating unit 25 or 26 shown in FIG. 3 in this application can be considered analogous to the led 81 shown in FIG. 7 of the '652 patent.

In accordance with the present invention, an addressable remote module 85 is provided, and includes both transponder 86 and module relay 87, which relay is coupled to the indicating unit 25. Module 85 also includes rechargeable battery 98. As will be seen, the addressable remote module 85 includes a circuit 89 which provides power, supervision and control functions.

Another remote module 179 is shown powering the strobe light or visual indicating device 26. The addressable remote module 179 is connected to the bus conductors, and includes rechargeable battery 178, and transponder and relay circuit 176 as shown. Module 179 also includes circuit 177 for providing power, supervision and control functions. Each of the transponders responds when its address is contained in the communication from controller 175, as explained in the three referenced patents.

In accordance with a significant feature of the present invention, the system for remotely charging a module and using its locally supplied battery power to energize a bell or strobe light can also be addressed from the controller. By way of example an addressable system is depicted and explained in U.S. Pat. No. 4,507,652, referenced above. FIG. 7 of that patent shows a block diagram of a transponder or remote module in that addressable system. In FIG. 7 the power for the transponder components passed over line 62 to detector 72 can also supply power such as that shown on conductor 61 in FIG. 2 of this application. The control signal shown on conductor 62 in FIG. 2 of this application can be considered like the common bus 63 in FIG. 7 of the referenced patent, which supplies output commands through output command controller 65 to different units, such as latching relay 75. This is analogous to supplying the control signal for actuating relay 43 in FIG. 2 of this application. The trouble output signal could be returned in the manner described in FIG. 7 of the '652 patent, that is, through analog conditioning circuit 68 and over bus 63, back to the controller. The preferred method of practicing the invention, and a further explanation, will be set out herein.

Figure 4:
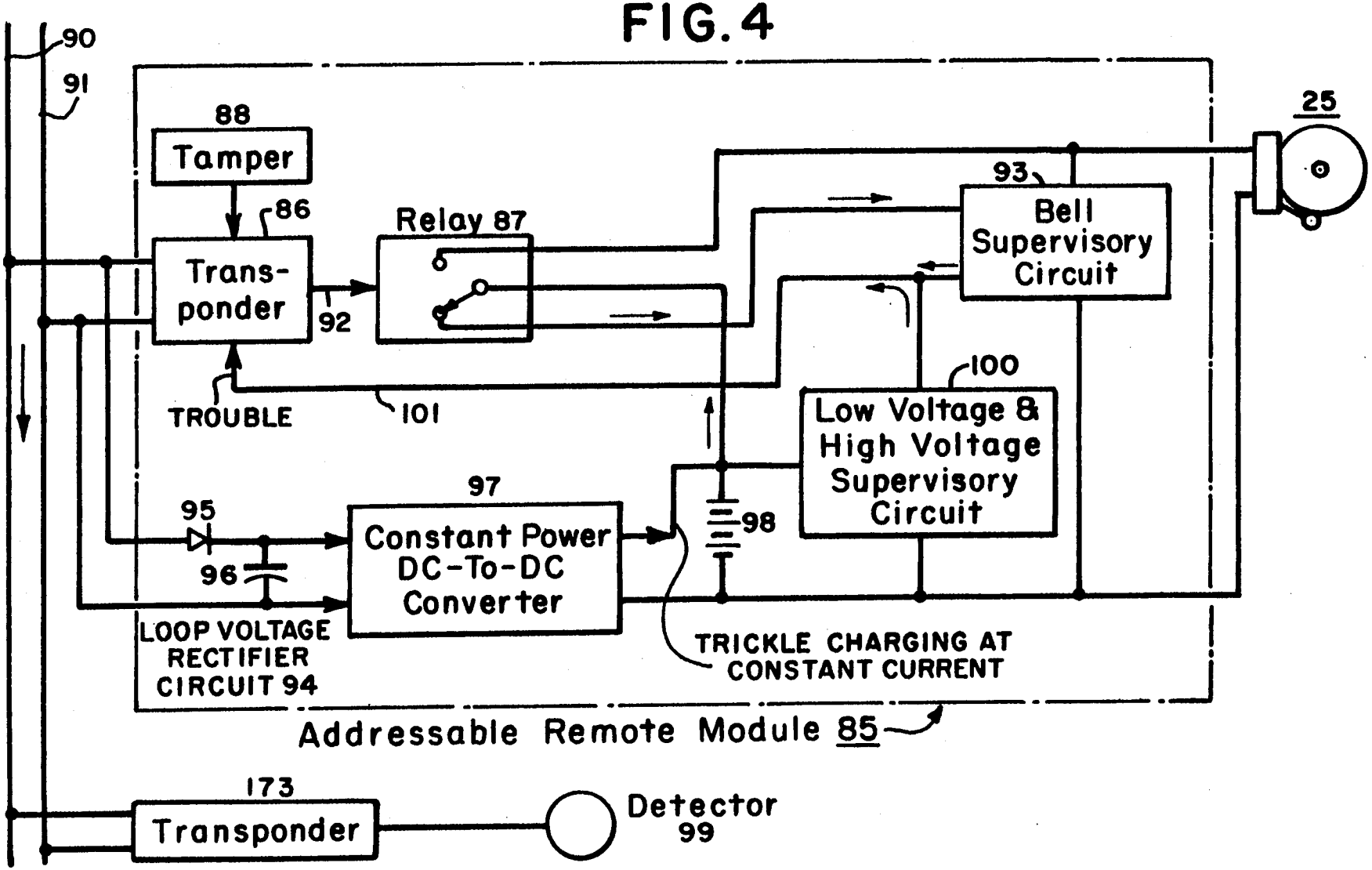
FIG. 4 is a block diagram, showing signal and power flows in an addressable remote module constructed in accordance with the invention.

FIG. 4 depicts the major subassemblies which together comprise the addressable remote module 85. In the module are the components that will be described hereinafter. The block designated transponder 86 is similar to a transponder shown in block diagram form in FIG. 7 of the '652 patent. Latching relay 75 of that same figure is analogous to relay 87 in FIG. 4 of this application. Tamper detector 88 is another conventional unit known in the art. Transponder 86 receives power over bus conductors 90,91, and passes trouble signals back through transponder 86 over the bus in the manner described previously. The output of transponder 86 passes a signal over line 92 to relay 87. As will become evident, the relay 87 controls the supply of power to the indicating device 25 and to bell supervisory circuit 93. Note that the trouble signal can be reported on the same transponder that commands the relay. Another transponder 173 can receive alarm or abnormal-condition indications from an initiating device such as detector 99. The detector can be a detector of particles of combustion, an obscuration detector, a rate of temperature rises detector, or any other unit which provides the information signal for passage through the transponder 173 and over the same conductive path 90,91 that provides the charging current to addressable remote module 85. This is a significant advantage provided by practice of the present invention.

The bus power and signals passed on lines 90,91 are received at loop voltage rectifier circuit 94, which includes a series connected diode 95 and a parallel-connected capacitor 96. The voltage on bus conductors 90,91 will be a pulsating voltage if the communication system described in the referenced patents is utilized, and circuit 94 rectifies this voltage to a dc voltage of approximately 15 to 28 volts dc. This voltage then is applied to the constant power dc-to-dc converter 97, used to charge the six volt rechargeable battery 98.

Generally the rechargeable battery 98 is of the nickel-cadmium (nicad) type, which is charged with a constant current. This is provided by converter circuit 97. Also the signals passed on bus conductors 90,91 are at a level of limited power capability. Thus efficient use of the power taken through loop voltage rectifier circuit 94 and converted in circuit 97 is necessary to effectively charge battery 98.

A battery high/low supervisory circuit 100 is provided and coupled across battery 98 as shown. Circuit 100 senses whether the battery voltage is too low or too high, whether it has an open cell, reverse cell, shorted cell, is connected in reverse, or whether it is excessively discharged or over-charged. If the battery voltage is too low, the battery may not be able to supply sufficient power to energize the bell or strobe light when required. If the voltage is too high, the battery may have gone to an open circuit condition, or has been disconnected and thus is not able to energize the indicating unit. Any of these problems will cause a trouble signal to be sent through transponder 86 back to the controller. A bell supervisory circuit 93 is provided to sense if the wires to the bell have been disconnected. If this occurs circuit 93 reports this condition to transponder 86. Note that this circuit is disabled when the bell is ringing as the relay contacts are switched, so as to prevent a false indication of a break in the bell circuit.

FIG. 5 depicts circuit details of the dc-to-dc converter used in the preferred embodiment of the invention. The output voltage ranging from 15 volts to 28 volts dc from loop voltage rectifier circuit 94 is provided between conductors 103 and 104. Conductor 104 is the reference or common conductor. There is a series circuit between these conductors comprising a pnp type transistor 105 (the emitter-collector path), inductor 106, resistor 107 and the rechargeable battery 98. A flywheel diode 108 has its anode connected to common line 104, and its cathode coupled between the common connection of inductor 106 and the collector of transistor 105. The base of this transistor is coupled to the common connection between resistors 110,111. The other side of resistor 110 is coupled to conductor 103, and the other side of resistor 111 is coupled to the collector of another pnp type transistor 112, the emitter of which is coupled through resistor 113 to conductor 114. The base of transistor 112 is coupled to the common connection between another resistor 115 and the collector of a third transistor 116, the emitter of which is coupled in common with the emitter of transistor 112. The other side of resistor 115 is coupled to conductor 114. The base of transistor 116 is coupled both to the common connection between inductor 106 and resistor 107, and to one side of a capacitor 117, the other side of which is coupled to conductor 114. Another resistor 118 is coupled between conductor 103 and the collector of transistor 116. A diode 119 has its cathode coupled to conductor 103, and its anode coupled to conductor 114.

In operation, the three transistors 105, 116 and 112 make up an oscillator which has a frequency of approximately 20 kilohertz. Together transistors 116 and 112 comprise a Schmitt trigger circuit, and transistor 105 operates as the switching transistor for inductor 106. As transistor 112 is alternately turned on and off, the voltage at the common connection between resistors 110 and 111 varies, providing a variation in the drive to the base of transistor 105, which is thus turned on and off. When transistor 105 is on, current increases or ramps up through the circuit including the emitter-collector path of transistor 105, inductor 106, resistor 107 and the rechargeable battery 98. When transistor 105 is turned off, the current through inductor 106 decreases and ramps down through diode 108, the rechargeable battery and resistor 107. Note the provision of inductor 106 maintains a charging current through rechargeable battery 98, whether transistor 105 is on or off. However only when transistor 105 is conducting is energy taken from the loop over the bus conductors 90,91 and transponder 86. That energy can be at a a low level, such as a voltage of 15 to 28 volts at a low current of approximately 2 milliamperes (ma). However the charging current supplied to the batteries is approximately 6 ma at 6 volts. The power output from the converter circuit is approximately equal to the power input, neglecting the minor switching losses. This circuit provides a constant power regulator for the battery since, if the battery charging current were to attempt to increase or decrease, the voltage across resistor 107 would change and cause the percentage of on/off time for transistor 105 to change, thus keeping the charging current constant.

FIG. 6 shows the high/low battery voltage sensing circuit 100 which receives the battery voltage from the converter circuit over conductors 114,104. A significant component of the circuit is the semiconductor circuit (or chip) 127, designated ICL 7665 and available from Harris Semiconductor. There are six resistors, designated 121–126, connected in the circuit as shown. Chip 127 receives an energizing voltage over conductor 128, and has its reference connection coupled to conductor 104. The low voltage sensing circuit includes resistors 121 and 123, coupled in series between conductors 114 and 104. From the common connection of these two resistors, resistor 122 is coupled to the first hysteresis input of chip 127, and a second connection of virtually zero resistance is made to the set 1 input. The first output connection of the chip is coupled to the second output connection, and over conductor 130 to the common connection between conductor 131 which goes to the bell supervisory circuit (FIG. 7), and a resistor 132, the other side of which is coupled to the cathode of a diode 133. The anode of this diode is coupled to conductor 101, for sending a trouble indication signal back to transponder circuit 86.

The high voltage sensing circuit includes sensing resistor 124, coupled in series with resistor 126 between conductors 114 and 104. The common connection of resistors 124,126 is coupled through resistor 125 to the second hysteresis input of chip 127. The common connection of resistors 124,126 is also coupled to the set 2 input connection of the chip.

The chip 127 is a special integrated circuit that senses two different voltages very accurately, and with a low power consumption. The voltage thresholds are determined by the resistors 121–126, which have a tolerance of about 1%. For a 6 volt desired battery voltage, these resistors can be easily sized to provide an alarm output if the voltage rises above 8.0 volts or falls below 5.5 volts.

FIG. 7 shows circuit details of bell supervisory circuit 93. Relay 87 (FIG. 4) is shown in FIG. 7 because of its functional relationship in the bell supervisory circuit. Relay 87 includes a normally open contact 135, a normally closed contact 136 and a movable contact 137. Resistor 138 is coupled between normally open contact 135 and movable contact 137. The common connection between movable contact 137 and resistor 138 is coupled to the cathode of a Zener diode 140, and to a terminal 141 which, with terminal 142, provides the connections to the bell motor, or to the strobe light if a light is used. The anode of Zener diode 140 is coupled to common conductor 104 and to terminal 142. Normally closed contact 136 of the transponder relay is coupled through a resistor 143 to the common connection between a capacitor 144, a resistor 145, and another resistor 146, with the other side of resistor 146 being coupled to the base of an npn type transistor 147. The other side of each of capacitor 144 and of resistor 145 are coupled to common conductor 104, as is the emitter of transistor 147. The collector of this transistor is coupled to conductor 131, to the point indicated in FIG. 6.

In the position shown of the relay contacts of relay 87 in FIG. 7, transistor 147 is non-conducting because the drive to its base is shorted out by the connection of the bell motor or the strobe light across terminals 141,142. If the indicating unit were disconnected from terminals 141,142, the drive to the base of transistor 147 is not shorted out, and this transistor becomes conductive. The transistor output from its collector is supplied over conductor 131 and through the components shown in FIG. 6 to conductor 101, providing a trouble indication to transponder circuit 86.

If the contacts are switched in relay 87, this rings the bell, but the drive to the base of transistor 147 is removed by breaking the previous contact with normally closed contact 136, and this prevents a false trouble signal. Capacitor 144, which was a 33 microfarad capacitor in the preferred embodiment, prevents motor-driven bells from causing a false trouble signal after the power to the bell has been shut off. The motor is still coasting and producing an output voltage, but this energy is absorbed in capacitor 144 and prevents the false trouble signal as mentioned.

Sometimes it is desired to have a voltage higher than 6 volts to drive indicating devices. FIG. 8 depicts a very efficient 6 volt to 24 volt converter, for use in this situation. The circuit of FIG. 8 employs a semiconductor chip 150, which is an oscillator operating at approximately 35 kilohertz. This chip is commercially available from Texas Instruments, and is designated TLC 555. The oscillator has two power inputs connected as shown to line 114, and a reference connection to line 104. The inputs include a first input connection between resistors 151 and 152, and two more common inputs coupled between the other side of resistor 152 and one side of capacitor 153, the other side of which is coupled to conductor 104. The output of oscillator chip 150 is coupled to a field effect transistor (fet) 154, the drain of which is coupled through an inductor 155 to input voltage conductor 114. The source of fet 154 is coupled to reference conductor 104. The common connection between the drain and inductor 155 is coupled to the anode of a diode 156, the cathode of which is coupled to terminal 157 and to one side of a capacitor 158, the other side of which is coupled to common conductor 104 and another terminal 160. A 24-volt horn or a strobe light can be connected between terminals 157 and 160. Terminal 157 is also coupled over a conductor 161 to an appropriate supervisory circuit, operating in a manner analogous to that of circuit 100 shown in FIG. 4.

The output of oscillator chip 150 turns the fet 154 on and off. This causes the current through inductor 155 to increase when fet 154 is on, and to decrease or ramp down when this fet is turned off. The voltage at the drain of transistor 154 pulsates between approximately 0 and 25 volts. This pulsating voltage is rectified in diode 156, and filtered in capacitor 158. The output is then applied to the 24-volt audible horn or strobe light. If desired, a low voltage cut-out circuit can be provided to sense if the battery voltage has become dangerously low. Under this condition it can cut off the battery and prevent damage to the battery, if the load is left on for too long a time period. Such a low voltage cutoff circuit is shown in FIG. 9.

As shown in FIG. 9, the battery low voltage cut out circuit is coupled to the 6 volt rechargeable battery 98. The circuit includes two pnp type transistors 165,166 and a fet 167. The emitters of both of transistors 165 and 166 are coupled to the 6 volt line 114. The base of transistor 165 is coupled through a resistor 168 to the second output connection of chip 127 (FIG. 6), the one which provides a signal when the output voltage provided by the battery goes too low. The collector of transistor 165 and the base of transistor 166 are connected together, and to one side of resistor 170, the other side of which is coupled to the drain of fet 167. This drain is also coupled to common conductor 104. The source of fet 167 is coupled through conductor 171 to one side of battery 198. Conductor 171 is also coupled to one side of a resistor 172, the other side of which is coupled both to the gate of fet 167 and to the collector of transistor 166.

In operation, if the voltage provided by the battery is in the normal range, a signal is applied to the base of transistor 165, which maintains this transistor off and thus allows transistor 166 to conduct. This conduction of transistor 166 turns on fet 167, providing a connection of common conductor 104 to conductor 171, and effectively connecting the battery in the circuit. However if the voltage to the battery goes low, this is signalled by the output from chip 127 (FIG. 6), and turns on transistor 165 (FIG. 9). This then turns transistor 166 and fet 167 off, effectively disconnecting conductor 171 from conductor 104 and removing the battery from the circuit.

TECHNICAL ADVANTAGES

The invention makes possible the provision of positive operation of an alarm indicating device, such as a bell, strobe light or horn, in an alarm transmission system in which power is transmitted from a control unit over a communication path to the various remote points in such a system. Provision of the rechargeable battery at the remote point in effect provides a larger reservoir for power. More than adequate power is contained in a relatively small battery, such as a 6 volt nickel-cadmium (nicad) battery. At the same time the power taken from the communication path is relatively low, at a current level of, by way of example, only 2 ma and a voltage level of approximately 24 volts. Using the dc-to-dc converter makes it possible to have a very efficient, constant current charging circuit which is most effective when nickel-cadmium batteries are used. In a preferred embodiment the inductor in the switching circuit of the dc-to-dc converter is kept very small, of the order of 100 millihenries. This small physical size contributes to the efficient design of the remote module. All the components shown in the remote module have been packaged in a size to fit in a standard electrical junction box. Also by minimizing the power taken from the communication path, loading of the supply circuit is minimized, and this maximizes the number of indicating devices that can be put on the line.

The supervision arrangement for the battery detects virtually all malfunction conditions, whether the battery has an open cell, shorted cell, a reversed cell, reversed battery, or discharged. Supervision of the bell or indicating device circuit is also provided, and the monitoring circuit knows whether a bell is connected or has an open circuit. In addition if a motor driven bell is used and the commutator corrodes, raising the resistance, this condition is also detected and signalled back to the controller.

The significant improvement in power distribution can be readily understood by comparing the earliest electromagnetic 6 volt bell circuits which drew about ¾ ampere, to the next generation of motor driven bells, which still required about 100 milliamperes (ma). Another order of magnitude advance has been realized with the present invention, where the current demand is down to less than 10 milliamperes. In particular when used with the teachings of the cited patents, the current drawn from the line is in the range of only 2 to 3 ma. To show the dramatic extent of this improvement, consider that earlier systems using electromagnetic bell circuits, 18 gauge wire, and 6-volt power at ¾ ampere, may be properly driven at a distance of about 100 feet from the power source. This distance may be increased to 700 feet by using 100 ma. motor driven bells. Using the system of this invention, it is possible to extend the distance to more than 350,000 feet, using the same 100 ma. bell type and same 18 gauge wire size.

In some earlier systems which used battery and charging power supply in the controller, remote from the module, a separate wire pair was run to the alarm bell. In those arrangements the voltage drop limited the number of bells and the distance from the controller at which the bell can be installed. An attempt was made to charge a remote battery positioned near the bell from the controller, but the charging current level was high, and was only applicable for a single bell, and this attempted solution did not prove satisfactory long distances and multiple bells. This led to providing a power supply with a battery and charging circuit at the remote module with the charging current being derived from a commercial ac power supply. Sometimes the nearest available ac connection was hundreds of feet away and this proved a severe disadvantage for this type of system. The ac power supply generally was large and would hang on a wall located near the remote module, providing an aesthetic problem.

The present invention has overcome these disadvantages by powering the rechargeable battery over the same wires which establish communication between the transponders and the controller. This eliminates the local ac power requirement, providing the charging current at a very low level current over the bus conductors. The conductive path provided by the bus conductors is a highway for both passing the information from initiating elements such as smoke detectors back to the controller, and supplying the power to the indicating devices energized from the remote module.

The present invention provides full supervision of both the battery and the bell circuit, and many bells can be used on the same two-wire circuit. The system is very inexpensive compared to the installed cost of present systems with alarm bells, strobe lights and horns.

In the appended claims the term "connected" means a d-c connection between two components with virtually zero d-c resistance between those components. The term "coupled" indicates there is a functional relationship between two components, with the possible interposition of other elements, or of air, between the two components described as "coupled" or "intercoupled".

In the appended claims, an "electrically conductive path" is normally at least two electrical conductors, but may include an additional conductor or, conductors, and/or an electromagnetic coupling unit, such as a transformer.

While only particular embodiments of the invention have been described and claimed, those skilled in the art will appreciate that other variations may be made. It is therefore the intention in the appended claims to cover all such modifications and alterations as may fall within the true spirit and scope of the invention.

What is claimed is:

1. An indicating system including a controller and at least one remote module, an indicating device coupled to the remote module, means in the controller to provide a control signal for activating the indicating device, means, including a rechargeable battery, positioned in close proximity to the remote module for supplying the electrical power to energize the indicating device when activated, and an electrically conductive path between the controller and the remote module, for passing electrical current from the controller to the rechargeable battery to provide a charge current level to the battery which is substantially less than the current level required to activate the indicating device, and for passing the control signal to the remote module to energize the indicating device.

2. An indicating system as claimed in claim 1, in which the electrically conductive path comprises a pair of electrical conductors, for passing both the charge current and the control signal to the remote module over the same conductors.

3. An indicating system as claimed in claim 1, in which the electrically conductive path comprises three electrical conductors, to afford separation between the charge current and the control signal passed to the remote module.

4. An indicating system as claimed in claim 1, including supervision means connected to monitor the rechargeable battery and to provide a trouble signal when an abnormal battery condition is sensed.

5. An indicating system as claimed in claim 1, including supervision means connected to monitor the indicating device and to provide a trouble signal when an abnormal condition of the indicating device is sensed.

6. An indicating system as claimed in claim 1, in which the indicating device is an audible alarm.

7. An indicating system as claimed in claim 1, in which the indicating device is a visual indicator.

8. An indicating system as claimed in claim 1, in which the indicating device is an audible alarm, and an additional indicating device which is a visual alarm is coupled to the remote module, for simultaneous energization of both the audible alarm and the visual alarm.

9. An indicating system as claimed in claim 1, in which the indicating device is an alarm bell.

10. An indicating system as claimed in claim 1, in which the indicating device is a strobe light.

11. An indicating system as claimed in claim 1, in which the indicating device is an alarm bell, and an additional indicating device which is a strobe light, is coupled to the remote module, for simultaneous energization of both the audible alarm and the visual alarm.

12. An alarm indicating system including a controller and a plurality of remote modules, each of which modules includes a transponder having an individual address which differs from the other transponder addresses, and means affording communication between said controller and the transponders such that each transponder recognizes when it has been individually addressed, comprising an alarm indicating device coupled to at least one of the modules, an electrically conductive path between the controller and the remote modules, to pass communications and charging current thereover, a rechargeable battery for actuating the indicating device upon receipt of a control signal, means in the controller to provide a control signal to the remote module for activating the alarm indicating device, means, including the transponder, for receiving control signals from the controller to turn on the indicating device, and for passing a trouble signal to the controller when an abnormal condition is detected in the remote module, and for providing charging current to the rechargeable battery, which charging current is at a level substantially less than the current level required to activate the indicating device, and means, including the rechargeable battery, for supplying electrical energy to power the indicating device when commanded.

13. An alarm indicating system as claimed in claim 12, in which the electrically conductive path comprises at least a pair of electrical conductors, for passing both the charging current and the control signal to the remote module.

14. An alarm indicating system as claimed in claim 12, including supervision means connected to monitor the rechargeable battery and to provide a trouble signal whenever an abnormal battery condition is sensed.

15. An alarm indicating system as claimed in claim 12, including supervision means connected to monitor the indicating device and to provide a trouble signal when an abnormal condition of the indicating device is sensed.

16. An alarm indicating system as claimed in claim 12, in which the indicating device is an audible alarm.

17. An alarm indicating system as claimed in claim 12, in which the indicating device is a visual alarm.

18. An alarm indicating system as claimed in claim 12, in which the indicating device is an audible alarm, and an additional indicating device, which is a visual alarm is coupled to the one remote module, for simultaneous energization of both the audible alarm and the visual alarm.

19. An alarm indicating system as claimed in claim 12, in which the means for providing charging current to the rechargeable battery includes a dc-to-dc converter, coupled between the conductive path and the rechargeable battery, for stepping up the current to an appropriate level for recharging the battery while drawing substantially less current from the conductive path.

20. An alarm indicating system as claimed in claim 12, in which the supervision means connected to monitor the rechargeable battery includes a high/low voltage sensing arrangement, connected to provide a trouble output signal when the battery voltage goes above a first preset level or below a second preset level.

21. An alarm indicating system as claimed in claim 12, in which a low voltage cut off circuit is coupled to the battery for effectively disconnecting the energy path to the battery when an abnormally low battery voltage is sensed.

22. An alarm indicating system as claimed in claim 12, wherein said alarm indicating device is connected to a first of said plurality of remote modules, and an initiating device coupled to a second of said plurality of remote modules, so that the initiating device and transponder in the second module can pass information to the controller over the same electrically conductive path used to pass the charging current from the controller to said first module.

23. An alarm indicating system as claimed in claim 12, in which the indicating device is an alarm bell.

24. An alarm indicating system as claimed in claim 12, in which the indicating device is a strobe light.

25. An alarm indicating system as claimed in claim 12, in which the indicating device is an alarm bell, and an additional indicating device, which is a strobe light, is coupled to the one remote module, for simultaneous energization of both the audible alarm and the visual alarm.

26. An indicating system including a controller and at least one remote module, an indicating device coupled to the remote module, means in the controller to provide a control signal for activating the indicating device, means, including a rechargeable battery, positioned in close proximity to the remote module for supplying the electrical power to energize the indicating device when activated, said indicator device being energized from said rechargeable battery, and an electrically conductive path between the controller and the remote module, for passing electrical current from the controller to the rechargeable battery to provide a charge current level to the battery which is substantially less than the current level required to activate the indicating device, and for passing the control signal to the remote module to energize the indicating device.

27. An alarm indicating system including a controller and a plurality of remote modules, each of which modules includes a transponder having an individual address which differs from the other transponder addresses, and means affording communication between said controller and the transponders such that each transponder recognizes when it has been individually addressed, comprising an alarm indicating device coupled to at least one of the modules, an electrically conductive path between the controller and the remote modules, to pass communications and charging current thereover, a rechargeable battery for actuating the indicating device upon receipt of a control signal, said indicating device being energized from said rechargeable battery, means in the controller to provide a control signal to the remote module for activating the alarm indicating device, means, including the transponder, for receiving control signals from the controller to turn on the indicating device, and for passing a trouble signal to the controller when an abnormal condition is detected in the remote module, and for providing charging current to the rechargeable battery, which charging current is at a level substantially less than the current level required to activate the indicating device, and means, including the rechargeable battery, for supplying electrical energy to power the indicating device when commanded.

* * * * *